US009506653B2

(12) United States Patent
Gerendás et al.

(10) Patent No.: US 9,506,653 B2
(45) Date of Patent: Nov. 29, 2016

(54) COMBUSTION CHAMBER OF A GAS TURBINE

(71) Applicant: Rolls-Royce Deutschland Ltd & Co KG, Blankenfelde-Mahlow (DE)

(72) Inventors: Miklós Gerendás, Am Mellensee (DE); Carsten Clemen, Mittenwalde (DE); Thomas Doerr, Berlin (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 0 days.

(21) Appl. No.: 14/641,883

(22) Filed: Mar. 9, 2015

(65) Prior Publication Data

US 2015/0260401 A1 Sep. 17, 2015

(30) Foreign Application Priority Data

Mar. 11, 2014 (DE) ..... 10 2014 204 481

(51) Int. Cl.
*F23R 3/00* (2006.01)
*F23R 3/60* (2006.01)

(52) U.S. Cl.
CPC ..... *F23R 3/002* (2013.01); *F23R 3/60* (2013.01); *F23R 2900/00012* (2013.01)

(58) Field of Classification Search
CPC ..... F23R 3/002; F23R 3/60
See application file for complete search history.

(56) References Cited

U.S. PATENT DOCUMENTS

| | | | | |
|---|---|---|---|---|
| 3,116,606 | A | 1/1964 | Dougherty et al. | |
| 3,653,207 | A | 4/1972 | Stenger et al. | |
| 4,158,949 | A | 6/1979 | Reider | |
| 4,422,300 | A * | 12/1983 | Dierberger | F23R 3/007 60/753 |
| 4,555,901 | A * | 12/1985 | Wakeman | F23R 3/08 60/752 |
| 4,614,082 | A * | 9/1986 | Sterman | F23R 3/002 60/752 |
| 4,628,694 | A | 12/1986 | Kelm et al. | |
| 4,912,922 | A * | 4/1990 | Maclin | F23R 3/002 60/757 |
| 4,944,151 | A | 7/1990 | Hovnanian | |
| 5,291,732 | A | 3/1994 | Halila | |
| 5,435,139 | A | 7/1995 | Pidcock et al. | |
| 5,758,503 | A | 6/1998 | DuBell et al. | |
| 6,453,675 | B1 | 9/2002 | Royle | |

(Continued)

FOREIGN PATENT DOCUMENTS

| | | |
|---|---|---|
| DE | 1291554 | 3/1969 |
| DE | 3424345 | 1/1986 |

(Continued)

OTHER PUBLICATIONS

German Search Report dated Mar. 27, 2014 from counterpart App No. 10 2014 204 481.2.

(Continued)

*Primary Examiner* — Carlos A Rivera
*Assistant Examiner* — Stefan Ibroni
(74) *Attorney, Agent, or Firm* — Timothy J. Klima; Shuttleworth & Ingersoll, PLC

(57) ABSTRACT

A combustion chamber of a gas turbine, including an external combustion chamber wall as well as an internal combustion chamber wall, wherein the internal combustion chamber wall, at its frontal end area as it appears with respect to the flow direction of the combustion chamber, is supported in a longitudinally slidable manner inside a groove of a base plate that is arranged in the area of a combustion chamber head, and is fixedly attached at the external combustion chamber wall at its back end area.

6 Claims, 12 Drawing Sheets

(56) References Cited

U.S. PATENT DOCUMENTS

| | | | | |
|---|---|---|---|---|
| 6,720,088 | B2 * | 4/2004 | Zhao | B32B 15/01 148/408 |
| 7,152,411 | B2 * | 12/2006 | McCaffrey | F23M 5/04 60/796 |
| 7,752,851 | B2 | 7/2010 | Daguenet | |
| 7,762,075 | B2 | 7/2010 | Pangle et al. | |
| 2005/0086945 | A1 | 4/2005 | Tiemann | |
| 2010/0146985 | A1 | 6/2010 | Buchal et al. | |
| 2012/0240584 | A1 | 9/2012 | Berdou et al. | |
| 2013/0251941 | A1 | 9/2013 | Garry et al. | |
| 2014/0109594 | A1 * | 4/2014 | Casavant | F02C 7/20 60/796 |

FOREIGN PATENT DOCUMENTS

| | | | |
|---|---|---|---|
| DE | 102008002981 | | 2/2009 |
| EP | 1284392 | | 2/2003 |
| EP | 1486732 | A2 | 12/2004 |
| EP | 1635118 | A2 | 3/2006 |
| EP | 1767835 | | 3/2007 |
| EP | 1777460 | A1 | 4/2007 |
| EP | 2402659 | | 1/2012 |
| GB | 1089467 | | 11/1967 |
| GB | 1539035 | A | 1/1979 |
| WO | 2011070273 | | 6/2011 |

OTHER PUBLICATIONS

European Search Report dated Jul. 13, 2015 for counterpart European application No. 15158432.3.

German Search Report dated Oct. 29, 2014 for related App. No. 10 2014 204 476.6.

European Search Report dated Jul. 20, 2015 for related European Application No. 15158435.6.

* cited by examiner

State of the art

COMBUSTION CHAMBER OF A GAS TURBINE

This application claims priority to German Patent Application No. 10 2014 204 481.2 filed on Mar. 11, 2014, the entirety of which is incorporated by reference herein.

The invention relates to a combustion chamber of a gas turbine. The combustion chamber has an external combustion chamber wall as well as an internal combustion chamber wall.

In the state of the art it is known to mount the internal, hot combustion chamber wall at the external, cold combustion chamber wall in a suitable manner, with the two combustion chamber walls being arranged at a distance from each other in order to create an intermediate space for the through-flow of cooling air. Here, the external, cold combustion chamber wall has a plurality of impingement cooling holes through which cooling air impinges onto the side of the internal, hot combustion chamber wall that is facing away from the combustion chamber interior so that it is cooled. The internal, hot combustion chamber wall has a plurality of effusion holes, through which cooling air exits and settles on the surface of the internal combustion chamber wall, thus cooling it and shielding it from the hot combustion gases.

Such combustion chambers are arranged between a high-pressure compressor and a high-pressure turbine.

The external, cold combustion chamber wall, which forms a support structure, is usually made by welding together prefabricated parts. At the outflow area of the combustion chamber, flanges and combustion chamber suspensions, which are made as separate forgings, are welded on in order to mount the combustion chamber. The combustion chamber walls themselves are usually embodied as sheet metal construction. At the front end of the combustion chamber, a combustion chamber head is provided, comprising a base plate that is usually carried out as a cast part. Then, an internal, hot combustion chamber wall is inserted into the interior of this external, cold combustion chamber wall. It usually consists of shingles, which are formed in a segment-like manner. The shingles are formed as cast parts and have cast-on stud bolts that are guided through recesses in the external combustion chamber wall and screwed in from the outside by using nuts.

Such constructions are already known from U.S. Pat. No. 5,435,139 A or from U.S. Pat. No. 5,758,503 A, for example.

Accordingly, in the solutions known from the state of the art, stud bolts are always used for attaching the internal combustion chamber wall (the shingles). In order to carry out this fixture in a functional manner, it is necessary to prestress the stud bolt by using the nuts. However, due to the high temperatures on the side of the hot, internal combustion chamber wall, the material of the stud bolt is so strongly stressed that the material starts to creep. Consequently, the prestress of the stud bolt diminishes. As a result, vibrations occur in the shingles of the internal combustion chamber wall. This may cause the fixture of the shingles to fail and the entire gas turbine to be destroyed.

Due to the material accumulation that occurs in that area, it is impossible to provide for an optimal cooling of those shingles that are close to the stud bolt. Therefore, higher temperatures occur in the transitional areas between the shingles and the stud bolt, exceeding the temperatures in any other area of the shingles.

Another disadvantage of the known solutions is the fact that in the area of the outlet nozzle of the combustion chamber a seal or a sealing lip is provided, which seals off the exiting stream from the surrounding structural components and supplies it to the guide blades of the high-pressure turbine. When a loosening of the shingles or a vibration of the shingles occurs, these sealing lips are subjected to wear and tear. Here, it has proven to be disadvantageous that the sealing lip is formed as a part of the support structure of the combustion chamber and cannot be replaced in a simple manner.

The invention is based on the objective to create a combustion chamber of a gas turbine of the kind that has been mentioned in the beginning and which offers a high degree of operational safety and has a high service life while also being of a simple construction and easy and cost-effectively to manufacture.

According to the invention, the objective is solved through the combination of features described herein, with the present description showing further advantageous embodiments of the invention.

Thus, it is provided according to the invention that, at its front end area as it appears in relation to the flow direction of the combustion chamber, the internal combustion chamber wall is supported in a longitudinally slidable manner inside a groove in the area of a base plate, which is assigned to a combustion chamber head. At its back end area, the internal combustion chamber wall is fixedly attached at the external combustion chamber wall.

With the solution according to the invention it is possible to form the first, cold combustion chamber wall in the way it is known from the state of the art, namely as a joint sheet metal part. The internally located, second, hot combustion chamber wall can be manufactured from a sheet metal material or in the form of cast segments or shingles. Through the mounting inside a groove at the base plate it is possible to provide longitudinal slidability, which particularly also allows for thermic expansion without any danger of damage occurring. At the back end, the internal combustion chamber wall (shingle) is fixedly attached close to the high-pressure turbine. According to the invention, this fixation can be carried out by using screws or a clamp ring that extends over 360°, or similar solutions, such as wheel clamps, for example. Thus, according to the invention, a form-locking fixation is achieved at the back area of the internal combustion chamber wall.

In an advantageous further development of the invention it can be provided that the internal combustion chamber wall is formed in a segmented manner, wherein the segments can extend over the entire length of the combustion chamber.

It can be particularly advantageous if the front end area of the internal combustion chamber wall is formed so as to be seal-like, for example by means of an additional ring flange or similar elements. Hereby, additional sealing is provided, which, however, does not compromise the longitudinal slidability of the front end area of the internal combustion chamber wall.

The attachment or fixation of the back end of the combustion chamber wall can be advantageously adapted to the respective constructional requirements, for example by means of screws, which can be arranged radially or axially with respect to the flow direction or a central axis of the combustion chamber.

A substantial advantage which is achieved according to the invention is that the cooling of the internal combustion chamber wall can be optimally designed across its entire surface. Since there are no stud bolts, there are also no restrictions arising with regard to heat transfer.

Another advantage of the embodiment according to the invention is the fact that it is possible to form the sealing lip against the outlet nozzle guide blade ring in such a way that it can be exchanged along with the internal combustion chamber wall when that is being replaced, without the whole combustion chamber construction being affected.

In the following, the invention is described by using exemplary embodiments in connection to the drawing. Herein:

Figure 1:
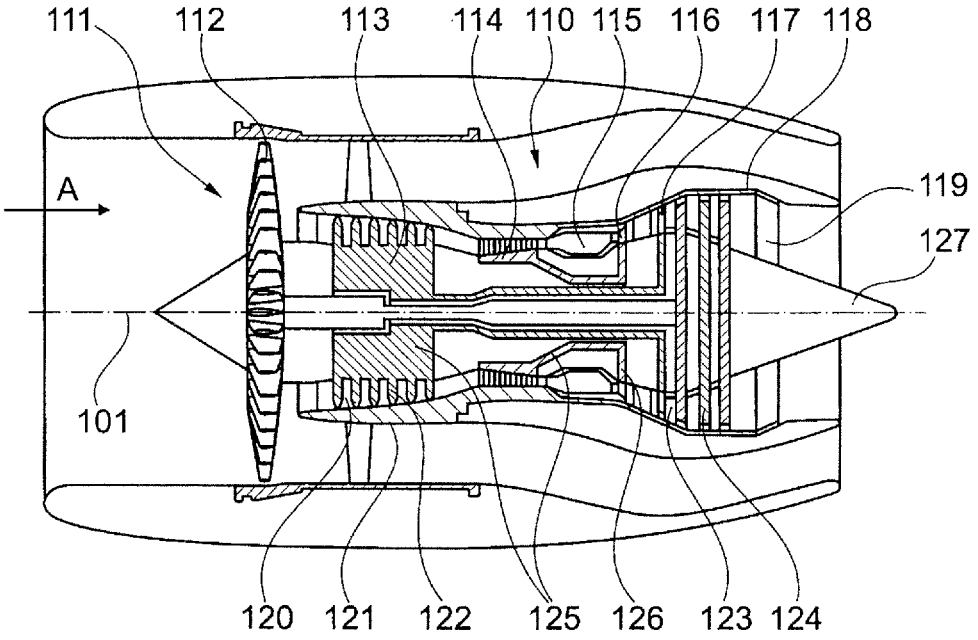
FIG. 1 shows a schematic representation of a gas turbine engine according to the present invention.

The gas turbine engine 110 according to FIG. 1 represents a general example of a turbomachine in which the invention may be used. The engine 110 is embodied in a conventional manner and comprises, arranged in succession in the flow direction, an air inlet 111, a fan 112 that is circulating inside a housing, a medium-pressure compressor 113, a high-pressure compressor 114, a combustion chamber 115, a high-pressure turbine 116, a medium-pressure turbine 117 and a low-pressure turbine 118 as well as an exhaust nozzle 119, that are all arranged around a central engine axis 101.

The medium-pressure compressor 113 and the high-pressure compressor 114 respectively comprise multiple stages, each of which has an array of fixedly attached, stationary guide blades 120 extending in the circumferential direction, which are generally referred to as stator blades and protrude radially inwards from the engine cowling 121 through the compressors 113, 114 into a ring-shaped flow channel. The compressors further have an array of compressor rotor blades 122 that protrude radially outwards from a rotatable drum or disc 125 coupled with hubs 126 of the high-pressure turbine 116 or the medium-pressure turbine 117.

The turbine sections 116, 117, 118 have similar stages, comprising an array of fixedly attached guide blades 123 that protrude radially inward from the housing 121 through the turbines 116, 117, 118 into the ring-shaped flow channel, and a subsequent array of turbine blades 124 that protrude outward from a rotatable hub 126. During operation, the compressor drum or the compressor disc 125 and the blades 122 arranged thereon as well as the turbine rotor hub 126 and the turbine blades 124 arranged thereon rotate around the central engine axis 101.

Figure 2:
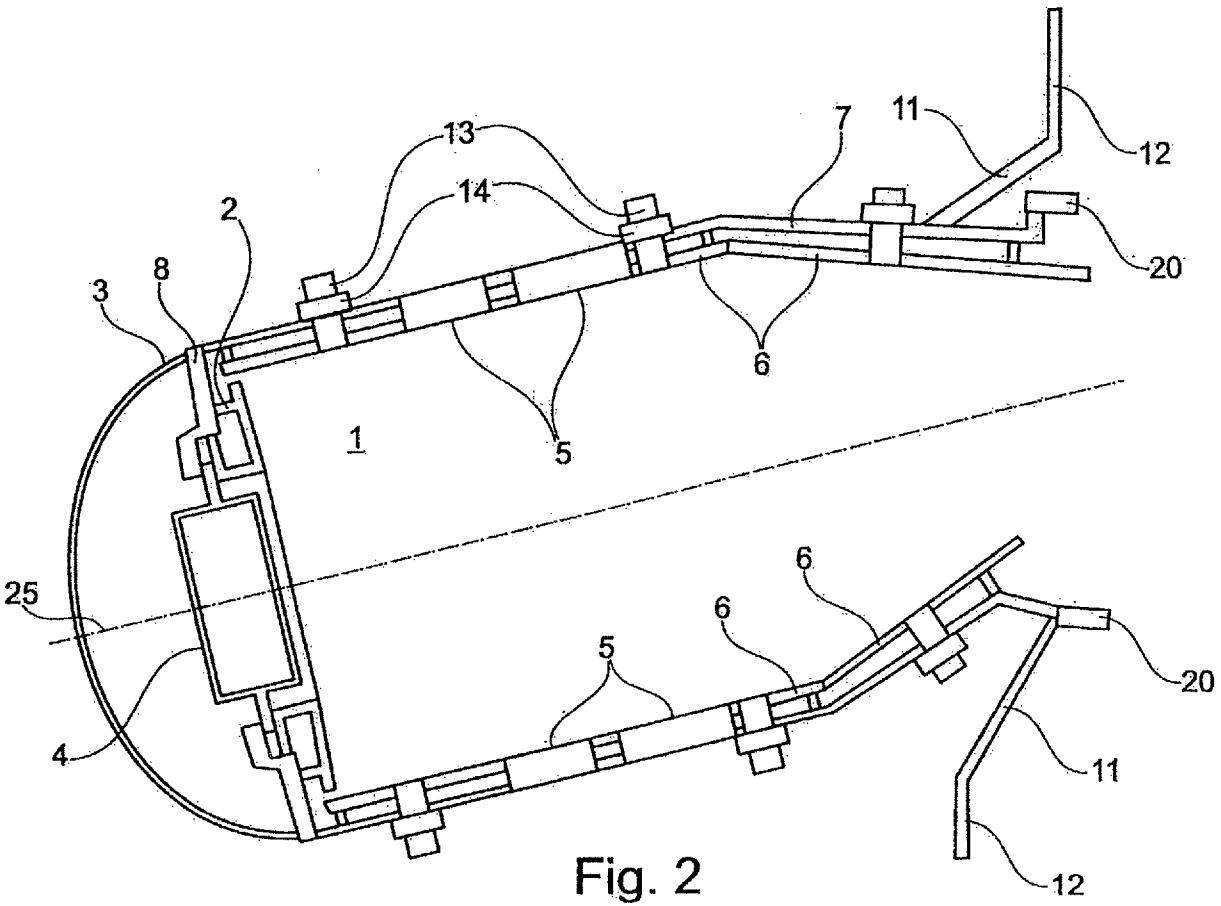
FIG. 2 shows a longitudinal section view of a combustion chamber according to the state of the art.

FIG. 2 shows an enlarged longitudinal section view of a combustion chamber wall as it is known from the state of the art. Here, a combustion chamber 1 with a central axis 25 is shown, comprising a combustion chamber head 3, a base plate 8 and a heat shield 2. A burner seal is identified by the reference sign 4. The combustion chamber has an external cold combustion chamber wall 7 to which an internal, hot combustion chamber wall 6 is attached. For the supply of mixed air, dilution air holes 5 are provided. With view to clarity, impingement cooling holes and effusion holes have been omitted in the rendering.

The inner combustion chamber wall 6 is provided with bolts 1, which are embodied as threaded bolts and are screwed in by means of nuts 14. At the outflow-side end of the combustion chamber 1, a sealing lip 20 for a strip sealing towards the outlet nozzle guide blade is provided. The mounting of the combustion chamber 1 is carried out by using combustion chamber flanges 12 and combustion chamber suspensions 11.

In the following exemplary embodiments like parts are identified by like reference numbers. Identical parts and identical solution aspects are not described again in detail for the different exemplary embodiments, respectively. Instead, it is referred to the text of the other exemplary embodiments.

Figure 3:
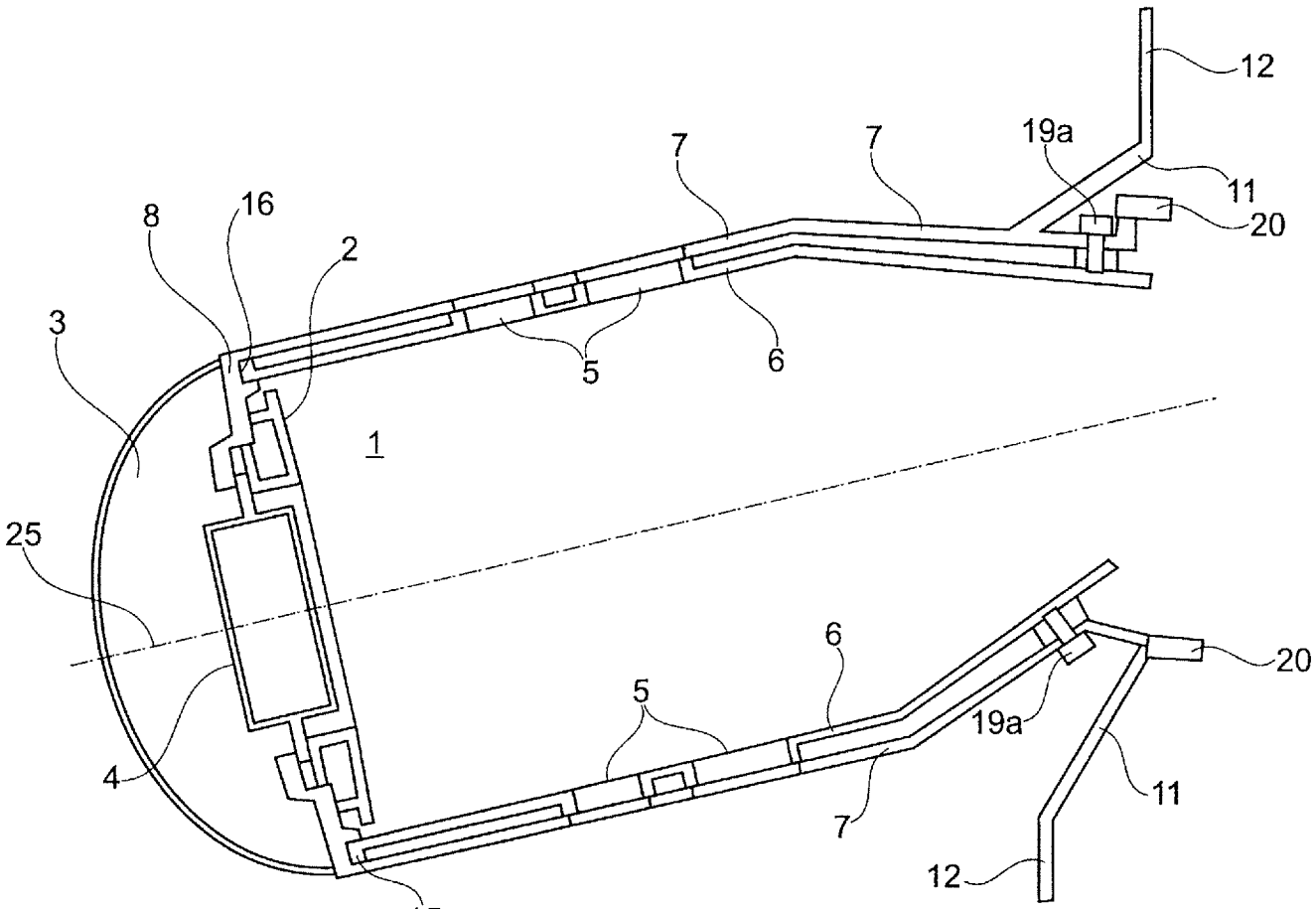
FIG. 3 shows a view, analogous to FIG. 2, of a first exemplary embodiment of the invention.

FIG. 3 shows a first exemplary embodiment of a combustion chamber according to the invention. Its basic structure is the same as the one of the combustion chamber that is shown in FIG. 2. This means that it also comprises an external, cold combustion chamber wall 7 as well as an internal, hot combustion chamber wall 6. Likewise, the mounting is performed by using combustion chamber suspensions 11 and combustion chamber flanges 12. Also, the sealing lip is respectively shown. At the front end a combustion chamber head 3, a heat shield 2, a base plate 8 and a burner seal 4 are provided.

In the solution according to the invention, a groove 16 is formed at the base plate 8, with a front end 15 of the internal combustion chamber wall 15 being inserted into that groove in a longitudinally slidable manner.

The back area of the internal combustion chamber wall 6 is fixedly attached at the external combustion chamber wall 7 by means of fastening screws 19*a*. In this area, the cooling does no longer play such a decisive role, so that this area is not subjected to extreme thermal loads.

Figure 4:
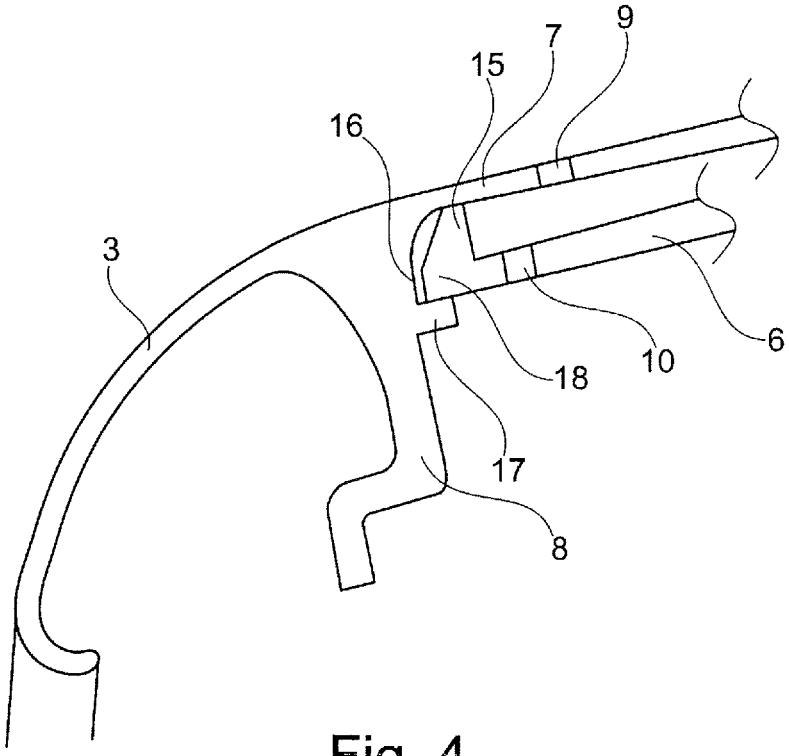
FIGS. 4 to 6 show different embodiments of the front mounting of the internal combustion chamber wall.
Figure 5:
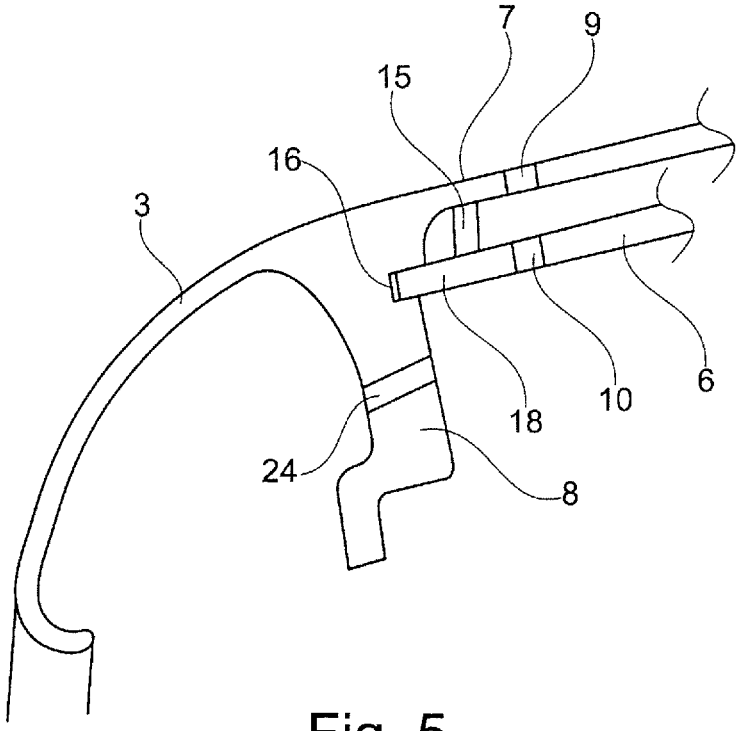
Figure 6:
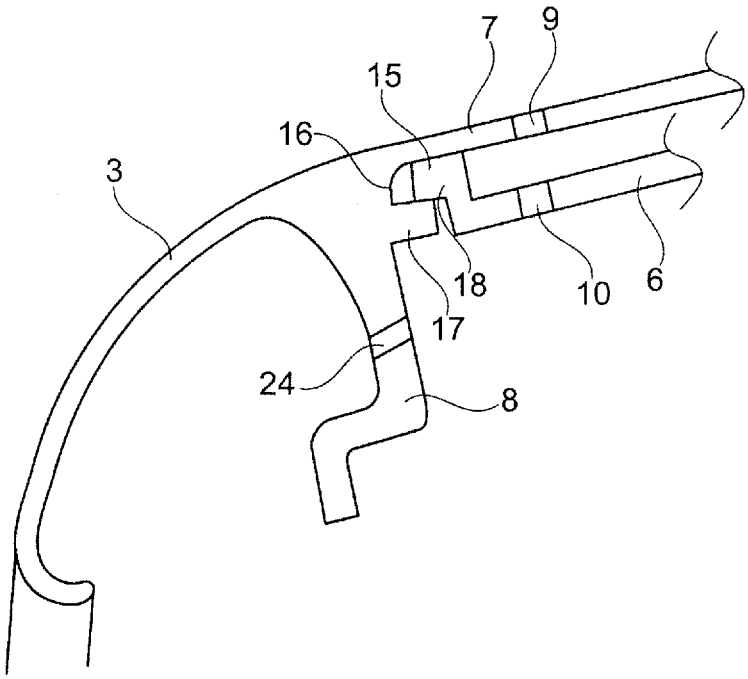

FIGS. 4 to 6 respectively show different embodiment variants for attaching the internal combustion chamber wall 6 at the base plate 8. In all three exemplary embodiments the base plate 8 has an annular groove 16. The front end of the internal combustion chamber wall 6 is inserted into the annular groove 16 in a longitudinally slidable manner. In the exemplary embodiment shown in FIG. 4, the groove 16 is formed by an circumferential web 17, just like the one that can be seen in the exemplary embodiment of FIG. 6. In the exemplary embodiment of FIG. 5, the groove 16 is incorporated into the material of the base plate 8 as an circumferential annular groove. In the exemplary embodiment of FIG. 4, the front end of the internal combustion chamber wall 6 has a ring-like bulge, which serves for mounting as well as for sealing. The impingement cooling hole 9 and the effusion hole 10 are schematically shown.

In the exemplary embodiment of FIG. 5, the head-side end 15 of the internal combustion chamber wall 6 is also formed as an circumferential ring web and also serves to provide sealing and support. The reference sign 24 indicates an additional air hole in the base plate 8.

The exemplary embodiment of FIG. 6 shows an angled embodiment of the head-side end 15 of the internal combustion chamber wall 6. That end is mounted inside the groove 16 formed by the circumferential web 17.

Figure 7:
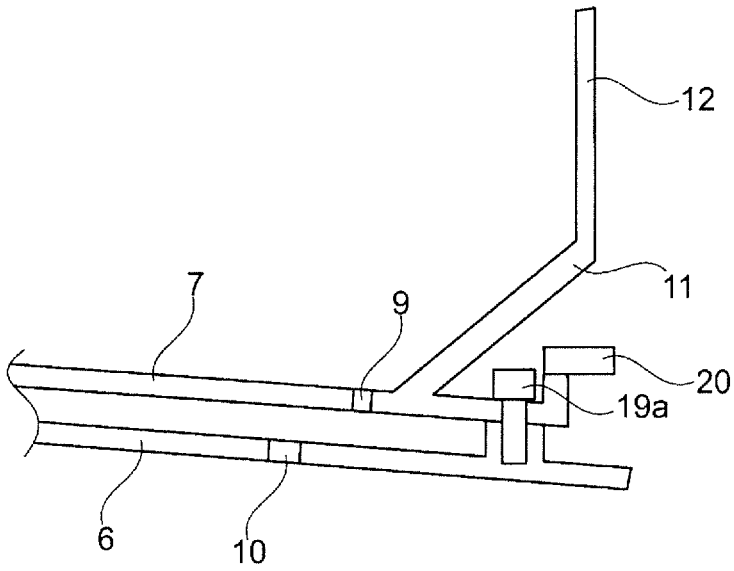
FIGS. 7 to 12 show different embodiments of the rear mounting of the combustion chamber wall.
Figure 8:
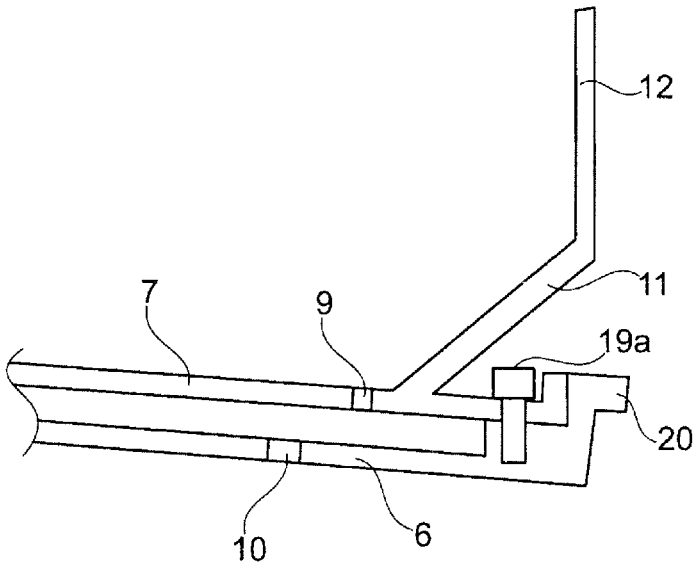
Figure 9:
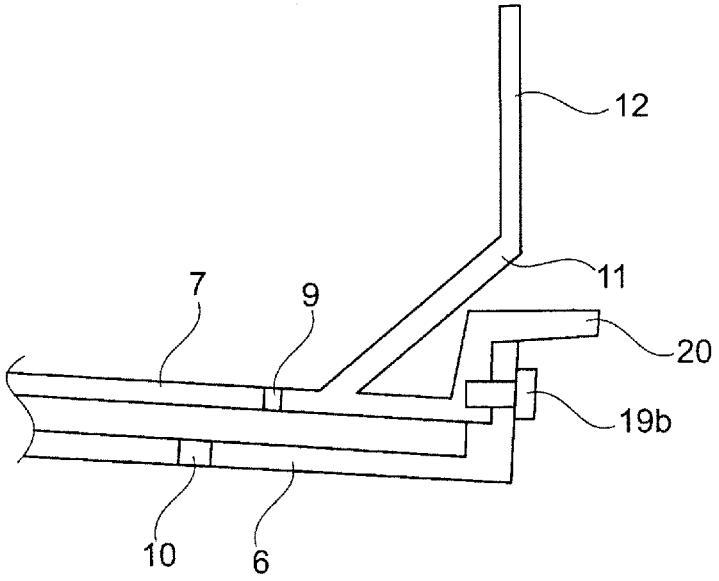

FIGS. 7 to 12 show the different embodiments of the rear mounting of the internal combustion chamber wall 6. FIG. 7 shows a solution in which a fastening screw 19*a* is screwed in in the radial direction. The sealing lip 20 is formed at the external combustion chamber wall 7. As an alternative to this, FIG. 8 shows an exemplary embodiment in which the sealing lip 20 is formed at the internal combustion chamber wall 6 and has an angled ring shape that abuts the end of the external combustion chamber wall 7.

Figure 10:
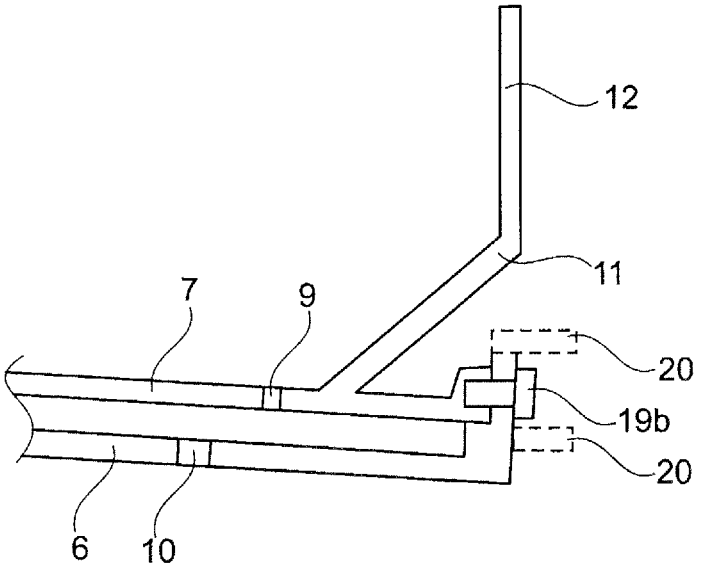

In the exemplary embodiments of FIGS. 9 to 12, the fastening screw 19*b* is respectively inserted in the axial direction. For this purpose, the internal combustion chamber wall 6 is formed so as to be angled. FIG. 10 shows an embodiment variant in which two sealing lips 20 are provided.

Figure 11:
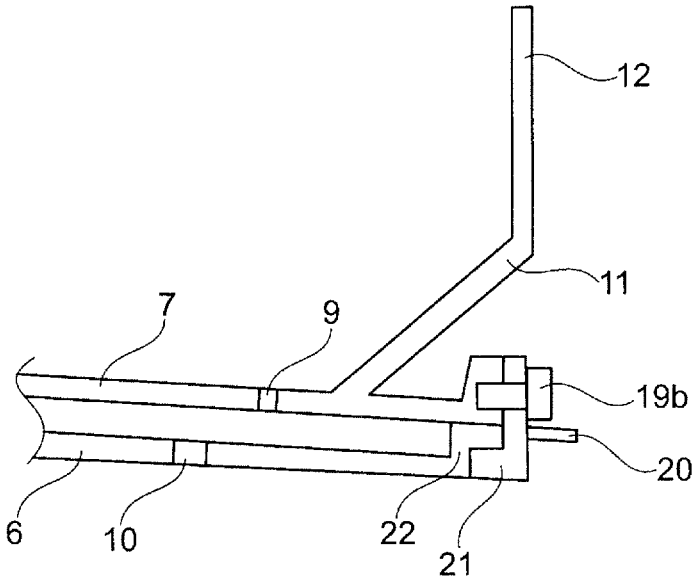
Figure 12:
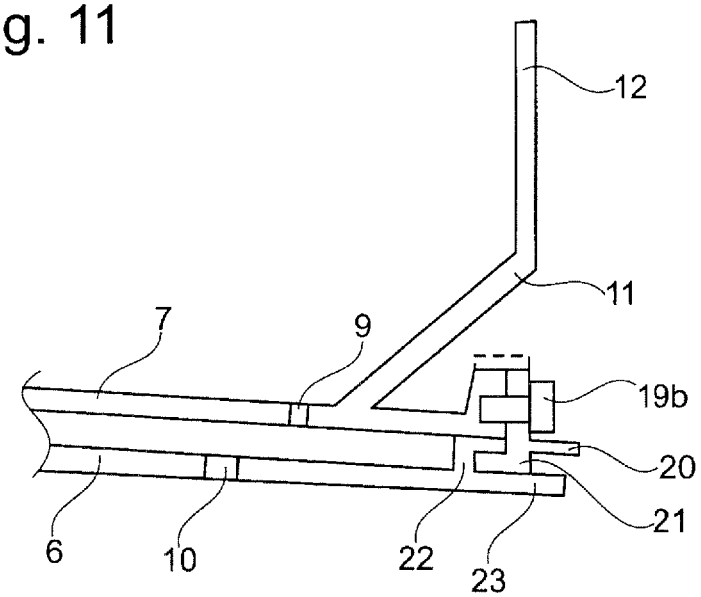

In the exemplary embodiments according to FIGS. 11 and 12, an additional lock ring 21 is provided that is formed as an circumferential ring or can be formed as a segmented wheel clamp. According to FIG. 11, the lock ring 21 supports the sealing lip 20. A similar solution is described in FIG. 12, wherein a projection 23 is additionally provided to protect the lock ring 21 or the groove 22 from hot gases.

Figure 13:
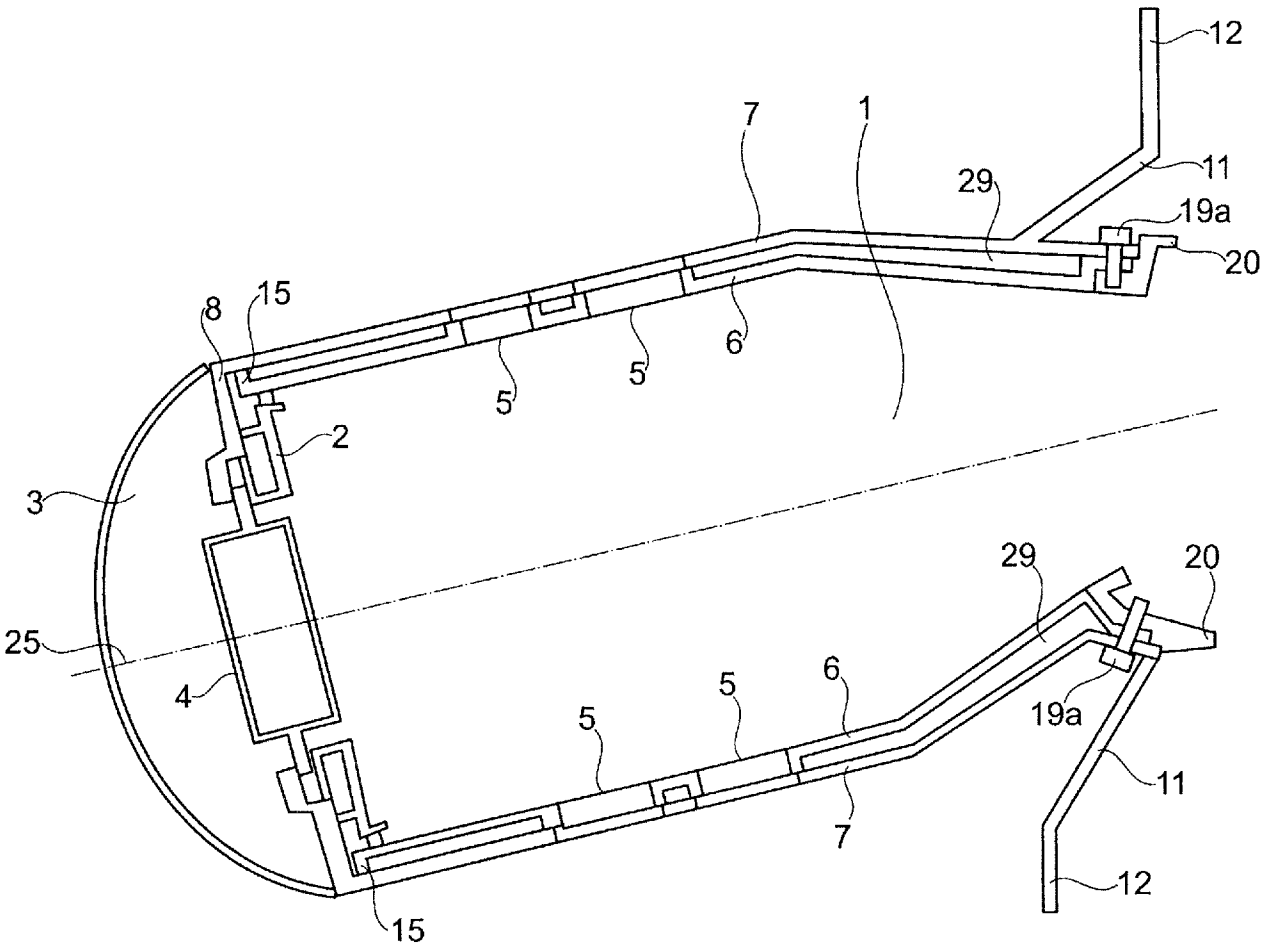
FIG. 13 shows a view, analogous to FIG. 3, of another exemplary embodiment of the invention.

FIG. 13 shows another exemplary embodiment in a rendering that is analogous to FIG. 3. In this exemplary embodiment the front, head-side end 15 of the internal, hot combustion chamber wall 6 is guided in a longitudinally slidable manner between the external cold combustion chamber wall 7 and the heat shield 2 inside a slit that is formed between these two structural components.

Figure 14:
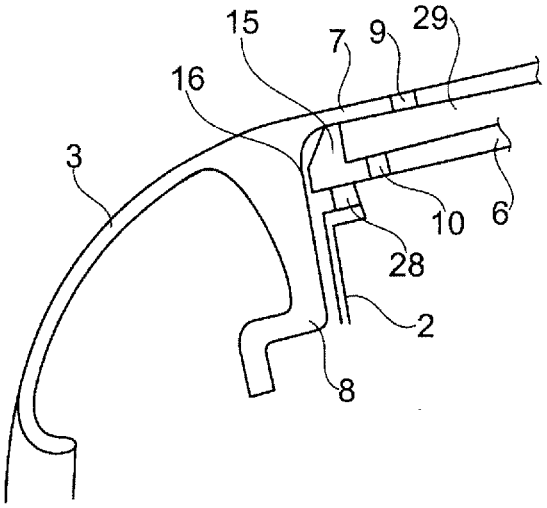
FIGS. 14 to 16 show different embodiments of the front mounting of the internal combustion chamber wall.
Figure 15:
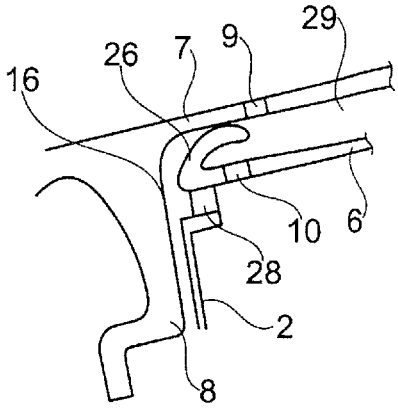
Figure 16:
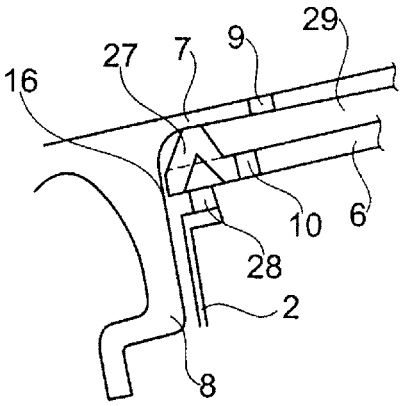
Figure 17:
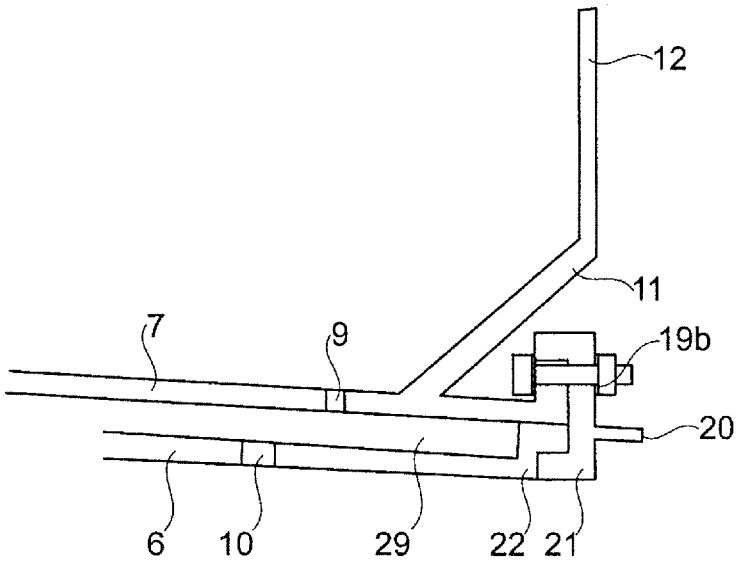
FIGS. 17 and 18 show different embodiments of the rear mounting of the combustion chamber wall.
Figure 18:
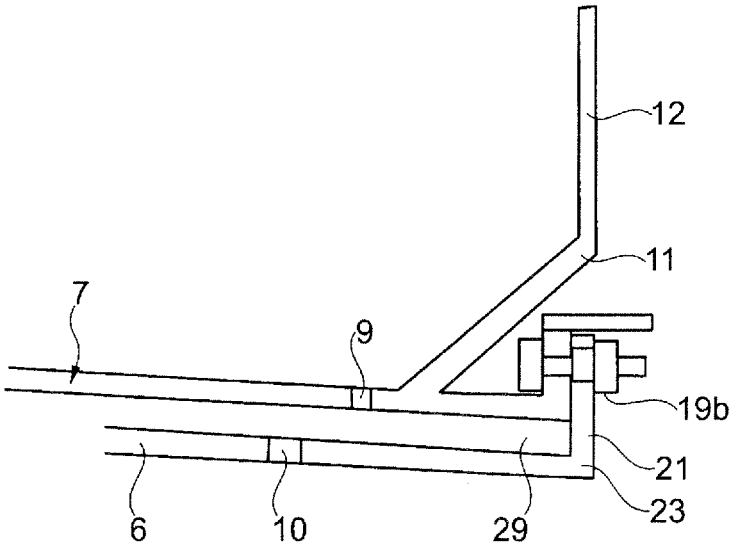

This external, cold combustion chamber wall 7 can be constructed in a conventional manner. The inner (hot) combustion chamber wall 6 is formed out of sheet metal (360°) or (possibly cast or sindered) segments (or shingles), which are characterized in that the cladding located at the side of the hot gases is guided around the burner in the front between the base plate 8 or the cold combustion chamber wall 7 and the heat shield 2 in such a manner that longitudinal slidability is facilitated. The hot combustion chamber wall 6 is fixedly attached at the back end (close to the turbine), for example by means of screws or a lock ring (360°) or wheel clamps (individual segments). Since a hollow space 29 must be formed between the two combustion chamber walls 6, 7, it is advantageous to thicken the head-side end 15 of the single 6 in order to set the distance. It can also be advantageous to compensate for the tolerances of the structural components through a certain radial flexibility. This can be achieved through bending 26 of the sheet metal located at the hot side into a C-shape or U-shape or through introducing a wave-shaped embossing 27. In FIGS. 14 and 15, a variety of embodiment variants is shown for this purpose. At the heat shield 2 respectively one support ring 28 is formed that supports the internal combustion chamber wall 6. According to FIG. 14, the head-side end 15 is formed with a thickened shape, in a manner also shown in FIG. 4. FIG. 15 shows a variant of the bent area 26, while FIG. 16 shows a wave-shaped embossing. Similar details can also be introduced in a cast or sindered variant. Also at the turbine-side end of the hot combustion chamber wall 6 the distance to the cold side must be bridged. For this purpose, a step can be imprinted in the hot side, so that the fixture (ring or segment) is not exposed to the hot gas flow as a protruding step, as it is shown in the FIGS. 17 and 18. Alternatively, a circumferential groove could also be inserted into the structural component located at the side of the hot gases, so that the holding clamp does not bear the full temperature load and thus can be made from an inexpensive material.

PARTS LIST

1 combustion chamber
2 heat shield
3 combustion chamber head
4 burner seal
5 dilution air hole
6 internal, hot combustion chamber wall/segment/shingle
7 internal, cold combustion chamber wall
8 base plate
9 impingement cooling hole
10 effusion hole
11 combustion chamber suspension
12 combustion chamber flange
13 bolt
14 nut
15 head-side end of the internal, hot combustion chamber wall 6
16 groove in base plate 8
17 circumferential web on base plate
18 web at shingle 6 matching groove 16 or web 17
19 fastening screw of the shingle (a: vertical, b: horizontal)
20 sealing lip for strip sealing toward the outlet nozzle guide blade (NGV)
21 lock ring (360°) or wheel clamp (segmented)
22 groove or step in the internal, hot combustion chamber wall 6 for meshing of lock ring
23 projection at internal, hot combustion chamber wall 6 for protecting lock ring and groove or step from hot gases
24 air hole
25 central axis
26 bent area
27 wave-shaped embossing
28 support ring
29 hollow space
101 central engine axis
110 gas turbine engine/core engine
111 air inlet
112 fan
113 medium-pressure compressor (compactor)
114 high-pressure compressor
115 combustion chamber
116 high-pressure turbine
117 medium-pressure turbine
118 low-pressure turbine
119 exhaust nozzle
120 guide blades
121 engine cowling
122 compressor rotor blades
123 guide blades
124 turbine blades
125 compressor drum or compressor disc
126 turbine rotor hub
127 outlet cone

The invention claimed is:

1. A combustion chamber of a gas turbine, comprising: a combustion chamber head positioned at a front area of the combustion chamber with respect to a flow direction; an external combustion chamber wall; an internal combustion chamber wall including a frontal end area and a back end area with respect to the flow direction, a base plate arranged in an area of the combustion chamber head; a groove formed at the front area of the combustion chamber, the groove extending in an axial direction of the combustion chamber; wherein the frontal end area of the internal combustion chamber wall is supported and is longitudinally slidable inside the groove and the back end area of the internal combustion chamber wall is fixedly attached to the external combustion chamber wall; at least one chosen from radially arranged screws and axially arranged screws engaging the back end area of the internal combustion chamber wall and the external combustion chamber wall to fixedly attach the back end area of the internal combustion chamber wall to the external combustion chamber wall; a heat shield positioned downstream of the base plate and spaced apart from the base plate to create an air gap between the base plate and the heat shield, the heat shield having an outer periphery having a smaller external dimension than an internal dimension of the external combustion chamber wall, the outer periphery being spaced inwardly away from the external combustion chamber wall to form the groove therebetween, with the heat shield forming a radially inner surface of the groove and the external combustion chamber forming a radially outer surface of the groove; a support ring radially extending from the outer periphery, wherein the support ring is configured to directly support and guide in a longitudinal slidable manner the internal combustion chamber inside the groove.

2. The combustion chamber according to claim 1, wherein the groove is formed in the base plate.

3. The combustion chamber according to claim 1, wherein the internal combustion chamber wall is segmented.

4. The combustion chamber according to claim 1, wherein the internal combustion chamber wall is at least one chosen from the following: equipped with shingles, includes shingles, and is formed as a shingle.

5. The combustion chamber according to claim 1, wherein the frontal end area of the internal combustion chamber wall forms a seal with the groove.

6. The combustion chamber according to claim 1, wherein the screws are arranged upstream of a sealing lip of a seal against an outlet nozzle guide blade.

* * * * *